US005410820A

United States Patent [19]

Goodman

[11] Patent Number: 5,410,820

[45] Date of Patent: May 2, 1995

[54] HINGED SHOE SOLE ASSEMBLY FOR FIXED AND VARIABLE HEEL HEIGHT SHOES

[76] Inventor: Michael C. Goodman, P.O. Box 1011, Bellflower, Calif. 90706-9998

[21] Appl. No.: 212,342

[22] Filed: Mar. 11, 1994

Related U.S. Application Data

[63] Continuation-in-part of Ser. No. 934,006, Aug. 21, 1992, which is a continuation-in-part of Ser. No. 702,588, May 17, 1991, abandoned.

[51] Int. Cl.[6] ..... A43B 13/00; A43B 21/36

[52] U.S. Cl. ..... 36/25 R; 36/36 R; 36/100; 36/102

[58] Field of Search ..... 36/25 R, 28, 32 R, 114, 36/102, 31, 30 R, 100, 36 R, 33

[56] References Cited

U.S. PATENT DOCUMENTS

| | | |
|---|---|---|
| Re. 32,394 | 4/1987 | Ehrlich . |
| 1,268,199 | 6/1918 | Zavarkin . |
| 1,493,565 | 5/1924 | Raboni . |
| 1,528,265 | 3/1925 | Roa . |
| 2,129,099 | 9/1938 | Pearson . |
| 2,157,818 | 5/1939 | Disch . |
| 2,177,571 | 10/1939 | Kirke . |
| 2,239,471 | 4/1941 | Srajer . |
| 2,450,250 | 9/1948 | Napton . |
| 2,466,580 | 4/1949 | Dalbey . |
| 2,478,664 | 8/1949 | Morrow et al. . |
| 2,517,472 | 8/1950 | Fathauer . |
| 2,590,648 | 3/1952 | Pitz . |
| 2,599,970 | 6/1952 | Barrons . |
| 2,707,341 | 5/1955 | Romano . |
| 3,032,895 | 5/1962 | Goldberg . |
| 3,121,962 | 2/1964 | Gullo . |
| 3,152,408 | 10/1964 | Thiessen . |
| 3,178,835 | 4/1965 | Burke et al. . |
| 3,266,177 | 8/1966 | Holden . |
| 3,455,038 | 7/1969 | Kasdan . |
| 3,464,126 | 9/1969 | Sarkissian . |
| 3,478,447 | 11/1969 | Gillead . |
| 3,481,053 | 12/1969 | Felice . |
| 4,059,910 | 11/1977 | Bryden et al. . |
| 4,177,582 | 12/1979 | Ehrlich, Jr. . |
| 4,262,435 | 4/1981 | Block et al. . |
| 4,309,832 | 1/1982 | Hunt . |
| 4,377,041 | 3/1983 | Alchermes . |

(List continued on next page.)

FOREIGN PATENT DOCUMENTS

| | | |
|---|---|---|
| 74924 | 11/1918 | Austria . |
| 20574 | 9/1915 | Denmark . |
| 2478441 | 9/1981 | France . |
| 219669 | 3/1909 | Germany . |
| 303072 | 1/1918 | Germany . |
| 307921 | 9/1918 | Germany . |
| 82787 | 10/1919 | Switzerland . |

*Primary Examiner*—Bryon P. Gehman
*Assistant Examiner*—Marie D. Patterson

[57] ABSTRACT

A high heel shoe designed such that the bottom of the foot of a wearer will contact the sole of the shoe along the same points that said foot would contact a smooth, level floor if standing with feet flat on said floor, providing the foot of a wearer with the same support surface in a high heel shoe that would be present in a flat shoe. The shoe sole structure hinges a forward sole section to a rigid rear sole section with a planar upper surface such that the straight hinge line passes below the lowest points of the first and fifth metatarsal heads of the foot of the wearer. The sole of the invention does not apply pressure in the sensitive arch area of the foot due to the planar nature of the upper surface of the rear sole section and it supports the ball and heel of the foot in the same manner as if the foot were standing on a flat surface. The rigid coupling between the forward and rear sole sections permits balancing forces from the toes to immediately counteract instability in the heel area. The upper surface of the rear sole section has the same medial to lateral tilt that is present during a normal walking motion. The heels of the invention are removable and the sole structure will function properly for both high heel shoes and for low heel or flat shoes.

4 Claims, 5 Drawing Sheets

U.S. PATENT DOCUMENTS 4,400,893 8/1983 Musci .
4,400,894 8/1983 Ehrlich .
4,403,426 9/1983 Kaplan .
4,416,072 11/1983 Sarkissian .
4,424,635 1/1984 Jourdan .
4,443,956 4/1984 Caccavale .
4,476,638 10/1984 Quacquarini et al. .
4,494,323 1/1985 Latraverse .
4,562,651 1/1986 Frederick et al. .
4,573,457 3/1986 Parks .
4,615,126 10/1986 Mathews .
4,628,936 12/1986 Langer et al. .
4,670,996 6/1987 Dill ..... 36/42
4,805,320 2/1989 Goldenberg et al. .
4,907,351 3/1990 Hirai .
4,924,607 5/1990 Harper .

HINGED SHOE SOLE ASSEMBLY FOR FIXED AND VARIABLE HEEL HEIGHT SHOES

CROSS-REFERENCE TO RELATED APPLICATION

This is a continuation-in-part of U.S. application Ser. No. 07/934,006 filed Aug. 21, 1992, which was a continuation-in-part of U.S. application Ser. No. 07/702,588 filed May 17, 1991, now abandoned.

BACKGROUND OF THE INVENTION

1. Field of the invention

This invention relates generally to high heel shoes and, more particularly, to high heel shoes with detachable heels.

2. An analysis of the prior art as related to the developmental history of the invention.

The invention in its present form was developed as a result of research into the problems associated with making high heel shoes with detachable heels that can also function as low or flat heel shoes. In investigating this problem, it became apparent that high heel shoes as they are currently manufactured can not be made to function as low heel or flat shoes when the heels have been removed. This is because high heel shoes have a very rigid arch structure permanently built in to them which does not go away if the heels are removed or broken off. A shoe in this configuration is unwearable for any reasonable walking motion without the heels. Conversely, flat heel shoes can't be modified to work as high heels. If high heels were attached to a conventional flat shoe, the result would be a very unstable shoe that would not stand up in the high heel position when worn. This is because flats are much more flexible than high heel shoes and any movement would cause the section of the shoe attached to the high heels to twist and the heels would collapse.

It was theorized that if a rigid, hinged-sole shoe could be built that would work comfortably as a flat, such a shoe would also provide a stable platform to which high heels could be attached because a hinged-sole shoe design could be built to be very laterally stable thus preventing the problem of heel collapse described above when high heels are attached to conventional flats.

Various hinged sole constructions with single and multiple hinge lines were attempted and none of the initial designs worked but it was noted that one prototype with a single hinge line running perpendicular to the length of the foot and in the general area of the ball of the foot exhibited a curious tendency to twist against the sandal straps when attempting to walk, as if the shoe were trying to align itself with some natural, built-in hinge line in the wearer's foot. To further research this phenomenon, a special test rig was made where there was a lot of surface area for the foot to slide around on near the hinge and elastic straps held the foot to the sole such that this twisting motion could be explored. It was found that any wearer's foot will automatically line up with a hinged sole construction in an exact way that can be defined precisely with regards to the anatomy of the foot of the wearer.

There are five bones in the foot called the metatarsals which project forward and downward toward the toes as shown in FIG. 7A. These long thin bones each have an approximately ball-shaped terminus at their forward-most end and these bulbous forward terminating points for the metatarsal bones are referred to as the metatarsal heads. It was found that for any walking or standing motion, the foot aligned itself with the hinged sole such that the hinge line 30 ran directly underneath the lowest or weight-bearing point of the first metatarsal head 31 (the one connecting to the big toe) and the lowest or weight-bearing point of the fifth metatarsal head 32 (the one connecting to the smallest toe). Further analysis showed that this is consistent with certain things already known about the weight-bearing function of the foot. A tripod is one of nature's most efficient weight-bearing designs and when standing still, the foot functions as a tripod with the weight from the leg coming down to the ankle area where it is distributed rearward to the heel and forward to the lowest points of the first and fifth metatarsal heads.

The human skeletal structure is designed to support body weight and the metatarsals form the forward structural support for the foot and thus no other weight bearing points are possible. Experimentation confirms the theoretical analysis that any normal, properly functioning foot will flex along a line which runs under the lowest points of the first and fifth metatarsal heads during walking or when standing in the high heel position. This is a universal condition not subject to variation from individual to individual.

Most shoes have a generally elliptical shape and in a shoe of such design, there was found to be a geometrical relationship which consistently matched the anatomical relationship just described. To derive the geometrical construct as shown in FIG. 8, the shoe perimeter must be placed flat on a surface between two parallel lines 5 & 6 such that each parallel line touches the perimeter at only one point and the distance between the parallel lines is at a maximum. A line drawn through these two points defines the long axis 7 of the shoe. If a line is drawn parallel to the long axis touching the perimeter at only one point, that point being on the side closest to the other foot, that point will be defined as the most medial point on the sole perimeter 8. If another line is drawn parallel to the long axis touching the perimeter at only one point, that point being on the side furthest from the other foot, that point will be defined as the most lateral point on the sole perimeter 9. In a typical shoe of generally elliptical shape, the natural hinge line of the foot will coincide with a line passing through the points most lateral 9 and most medial 8 on the sole perimeter.

All further prototypes were built with a single hinge line oriented in exactly this way and, as a manufacturing expedience, the rear portions of the sole were made to be absolutely planar. The sole construction has a forward section with an upper and a lower surface, a rear section with an upper and a lower surface and a straight hinge line joining both sections in the manner described above anatomically and geometrically such that when the shoe is upright on a flat surface(the ground), the upper surfaces of the forward and rear sole sections along the hinge line are at the same height above the ground. Subsequent testing proved that the design did indeed work very well as both a high heel shoe and as a flat shoe. Even though the sole of the design is absolutely rigid, being made out of aluminum which will not bend at all and which only flexes along the hinge line, it was found that when worn as flats, the shoes felt exactly like regular flat shoes with no inhibiting sensations or restrictions to movement of any kind. A most unexpected result which took a long time to research and explain, however, was the fact that wearers of the prototypes in their high-heel configuration often commented very strongly about how comfortable these shoes were as high heels, expressing the view that they were much more comfortable than conventional high heels as the wearers had previously experienced them.

It has long been known that high heel shoes as they have been manufactured to date are orthopedically unsound, being painful and damaging to the feet. This is because the built-in arch of conventional high heel shoes does not correctly match the anatomy of the human foot. The high heel shoe arch is used to provide a very rigid structure so that the high heels won't collapse when weight is applied downward on the heels. As mentioned already, if a high heel was attached to a flexible flat shoe and weight was applied in some direction other than straight down the middle of the heel, the heel would twist in relation to the shoe and foot and collapse, winding up pressed sideways between the foot and the ground. The conventional high heel arch is so stiff that this collapse will not occur but the shoe arch winds up working in a way that is painful and damaging to the arch of the wearer's foot.

A review of basic civil engineering principles shows that the purpose of an arch is to shift the point at which weight is applied. Thus, weight applied to the top middle of an arch will be diverted so that it comes down on the two end points of the arch, traversing the span under the middle of the arch without coming down through the middle of the span(arch). Arches are very strong when weight is applied down on the convex side but are very weak when weight is applied up into the concave side. As can be seen in FIG. 1, the arch is very strong and resistant to forces acting in a downward direction but if a significant force were applied in an upward direction into the arch, the bridge would be damaged, possibly seriously enough to cause structural failure.

FIG. 2 shows a human foot standing on a flat surface. The weight coming down from the leg is projected rearward onto the heel and forward onto the ball of the foot (the metatarsal head area). Notice how the area under the arch of the foot is clear of any contact with the ground so that no weight is felt there. If a hard object were to be placed under the arch of the foot so that the weight from the leg were to be transmitted through the arch against the hard object, the ability of the heel and ball of the foot to make firm contact with the ground would be interfered with and the woman whose foot is shown in FIG. 2 would experience considerable pain. This is exactly the effect that is experienced when wearing conventional high heel shoes.

The conventional high heel shoe's arch starts in the heel area and curves forward and down, generally reaching the ground behind the first metatarsal head. The arch curvature lifts the fifth metatarsal head off the ground so that it can't make firm contact with the ground. For high heel shoes with loose-fitting uppers such as high heel sandals, the first metatarsal head will often slide back against the shank but this exaggerates the tendency for the fifth metatarsal head to be lifted up off the ground. Forward of the arch, the shoe sole is flexible and this is where the shoe bends during walking. Thus, the arch of the shoe presses up into the arch of the foot, forcing the foot to bear weight in the sensitive arch area. The arch of the foot also rocks back and forth in this position against the arch of the shoe as weight is shifted from the heel of the foot to the ball of the foot during walking. This rocking motion also causes chafing of the foot against the uppers of the shoe, particularly causing friction and abrasion between the rear of the heel of the foot and the rear upper of the shoe. There is a misconception that has been held by some that the shape of the arch of the foot changes during the walking motion and that the arch of the foot has a different curvature when wearing high heel shoes than when wearing flats. This issue has been carefully researched and it has been found that there is a fixed planar relationship between the heel and the first and fifth metatarsal heads that remains constant when weight is applied on the foot. Thus, the planar relationship between the heel and the ball of the foot as shown in FIG. 2 is identical to the planar relationship between the heel and the ball of the foot in FIG. 3. The arch does not change shape and the distances between the heel and the first and fifth metatarsal heads remain constant regardless of whether the woman is standing flat as in FIG. 2 or up on her toes as in FIG. 3.

As an additional note, what is generally referred to as the arch of the foot is in fact a series of five arches adjacent to each other. The first metatarsal bone and the heel form part of the first arch which is the highest arch with the greatest curvature while the fifth metatarsal bone and the heel form form part of the fifth arch which is the lowest with the least curvature. When referring to the arch of the foot, what is meant is the bottom surface of the foot between the heel and the metatarsal heads. The woman in FIG. 2 has a particularly high arch as there is an air gap between her foot and the ground all the way from beneath her first metatarsal bone to beneath her fifth metatarsal bone. More typically, the flesh of the foot is in contact with the ground along the line below the fifth metatarsal bone. For someone who is flat-footed, the flesh of the foot is in contact with the ground below all the metatarsal bones.

Thus, the invention as described herein will perfectly track the motion of the wearer's foot whether walking, standing, dancing or merely at rest in the high heel position. If the invention were placed under the foot in FIG. 2, it would feel exactly the same as if nothing was there and the wearer were just standing barefoot on a smooth flat surface. If the foot in FIG. 2 were to rise up to the position shown in FIG. 3, the hinged sole would follow the motion of the foot, flexing exactly along the natural hinge of the foot wherein the first and fifth metatarsal heads (ball of the foot) remain in contact with the ground and the heel rises.

It should be noted that the first and fifth metatarsal heads aren't always both in contact with the ground at the same time. If the woman in FIG. 3 were to turn her body to her right with her feet where they are, the fifth metatarsal head of her left foot would leave the ground and more weight would press down on the first metatarsal head and toes of that foot. Nonetheless, the planar geometric relationship that exists between the first metatarsal head, fifth metatarsal head and heel that is the same in FIGS. 2 and 3 would be preserved in this other condition as well. As the woman twisted her body and the fifth metatarsal head of her left foot lifted up off the ground, the small toes would be lifted off the ground by the forward sole segment of the invention. Experiments have shown that wearers do not have any sensation of this and the shoes still feel perfectly natural. This is an important reason why the invention can be worn with no discomfort or inhibition of movement.

If the invention in its high heel configuration were fitted to the foot in FIG. 3, and the wearer were to stand at rest in the high heel position, the following significant orthopedic advantages over conventional high heel shoes would be experienced. No pressure would be applied up into the sensitive arch area of the foot and the natural weight bearing characteristics of the foot as seen in FIG. 2 would be very closely preserved. The first and fifth metatarsal heads(ball of the foot) would be provided firm, uninhibited contact with the ground and the heel of the foot would rest against the inclined rear planar section of the invention in exactly the same way it would contact'the ground in FIG. 2. Also, the ball of the foot would have a supportive surface to rest against both forward of and to the rear of the hinge line. In conventional high heel shoes, the arch starts in the heel area and curves forward and down, generally reaching the ground behind the first metatarsal head. This results in a lack of support in this area which is why women wearing conventional high heel shoes experience pain in the ball area of the foot as well as in the arch area of the foot. Quite a few women who have worn the prototypes in their high heel configuration have commented that the shoes "massage" the ball of the foot while walking, providing a very pleasant supportive sensation in that area whereas conventional high heel shoes cause an exaggerated strain to be present in that area. This additional support in the ball area of the foot also eliminates the tendency of conventional high heel shoes to cause the toes to be shoved forward against the upper of the shoe. Thus, conventional high heel shoes apply pressure in an area that they shouldn't which is the arch of the foot but fail to provide the necessary supporting pressure for the ball of the foot which needs a firm surface to rest against.

In fact, the term "arch support" is really a false concept. In a flexible-soled flat shoe, cushioning is needed under the arch to protect the sensitive arch area from the intrusion of hard objects that one might step on but this cushioning acts as a barrier to penetration and not as a support to hold up the arch. The arch of conventional high heel shoes is there to stiffen the shoe so the heels don't collapse but totally violates the correct orthopedic condition of the foot. The invention provides a rigid sole section that will act as a perfect barrier between the foot and the ground when the shoe is in the flat heel configuration and thus no padding is needed to push up into the arch of the foot to provide protection from foot impact with such objects as rocks or irregular walking surfaces.

Above are summarized orthopedic advantages of the invention with regards to pain experienced in the foot but another attribute of the invention greatly reduces pain experienced in the lower back. When the foot is flat on the ground as in FIG. 2, the bottom of the heel faces downward but when the heel rises as in FIG. 3, the bottom of the heel not only faces downward but also faces in a medial direction toward the other foot. Thus, during a natural walking motion, as the heel rises it also tilts such the bottom of the foot on the medial side of the heel area is higher up off the ground than the bottom of the foot on the lateral side of the heel area. Conventional high heel shoes do not take this tilt into account as can be seen in FIGS. 4 and 5 of F. T. Romano, U.S. Pat. No. 2,707,341 dated May 3, 1955. FIG. 4A of this application shows the view from the rear of the left heel of this invention and it correctly matches the natural foot alignment shown in FIG. 3. The heel itself is vertical but the top has been inclined to support the rear planar sole section of the invention at the angle it assumes in the high heel position. FIG. 4B shows the view from the rear of the right heel. To demonstrate the effect involved, stand with both feet as in FIG. 3 and then twist both heels into a vertical alignment as is required to wear conventional high heel shoes. Experiments indicate that allowing the foot to rest in the high heel position with the natural medial to lateral tilt of the heel shown in FIG. 3 supported by a sole surface that tilts as shown along the top of the shoe heel in FIG. 4A results in most of the lower back pain associated with conventional high heels being eliminated.

Another significant comfort advantage of the invention over conventional high heel shoes is the stability provided by the rigid hinged connection between the rear sole section and the front sole section. This feature allows balancing forces from the toes to be applied against the forward sole section to aid in controlling instability of the shoe that will occur when wearing a high heel. In conventional high heel shoes, the rear section with the arch is very rigid and contacts the ground behind the first metatarsal head which rests on a flexible section. This results in unwanted flexibility between the area of the sole under the ball of the foot and the surface below the arch and heel of the foot. Thus, the toes can not exert a balancing force that will stabilize a wobbling heel. As was mentioned earlier, there is a fixed relationship between the ball and heel of the foot but conventional high heel shoes do not incorporate this geometry into their design and thus the foot and shoe wobble in relationship to each other as the foot seeks out a stable platform while walking or standing. This effect comes from the inability of the heel and ball of the foot to simultaneously bear weight properly due to the incorrectly arched surface of the shoe sole and also due to the tendency of the feet to tilt laterally as in FIG. 3 while the shoe tries to twist the feet so that the heels will be perfectly vertical. The invention incorporates the correct medial to lateral tilt of the heel area of the foot and a rigid coupling between heel and ball of the foot so wobbling of the foot and shoe is eliminated. Eliminating this motion between foot and shoe also eliminates the chafing that occurs in conventional high heel shoes between the foot and the upper of the shoe.

During a normal walking motion, the heel rises from zero height as seen in FIG. 2 to some maximum height at which point the ball of the foot leaves the ground. The larger the shoe size, the higher the heel rises before the ball of the foot lifts and this maximum heel elevation during a normal walking motion wherein the ball of the foot is still firmly planted on the ground as in FIG. 3 is the effective maximum heel height at which the invention will still be orthopedically effective. For an average size foot, five inches heel height is about the maximum height at which the orthopedic advantages described above will still be experienced. For heel heights less than one inch high, the differences between the invention and a conventional shoe are negligible and thus the invention is specified as being effective when the attached heel raises the rear sole section such that it rises between one and five inches, such rise being measured as the difference in elevation between the lowest point of the upper rear sole surface(at the hinge) and the highest point of the upper rear sole surface(behind the back of the heel).

Patent searches revealed a large number of shoe designs with hinged soles. Reviewing this prior art, it is seen that virtually every possible hinged shoe arrangement has been described with single and multiple hinge assemblies shown with a wide range of hinge positions and hinge orientations. Many of the prior art examples were recognized as early prototype design attempts that were experimented with and found not to work. As was described above, the inventor discovered through extensive experimentation that there is one and only one rigid hinged sole assembly that will allow for proper foot movement. The only prior art example that shows this correct design is Danish Patent # 20574 dated Sep. 8, 1915 by D. Kapskobund and therefore, the Kapskobund design was closely analyzed to see what its intended function was.

The Kapskobund shoe is clearly seen to be a standard European clog which has been modified by the insertion of a hinge which is spring-loaded in the non-flexed(flat sole) position by two springs below the upper surface running parallel to the long axis of the clog. Historically, clogs were developed for use in the north coastal areas of Europe such as Holland and Denmark where the ground is often wet with standing water forming large puddles in the lowlands. The purpose of clogs is to provide a high platform shoe made out of wood which keeps the foot elevated above puddles and which insulates the foot against wetness. In the past, the Japanese also developed clogs which they called "geta" for the same purpose. The dynamics of the walking motion when wearing clogs can be analyzed with the help of FIGS. 5A and 5B showing a side view of Japanese geta which work the same as European clogs. A foot rests against the top of the clog in FIG. 5A in the same orientation as the foot in FIG. 2. When walking forward, the clog rocks down into the position shown in FIG. 5B and also, the clog rotates such that the front of the clog points slightly away from the other foot and the back of the clog points slightly toward the other foot. What the clog motion is trying to accomplish is to simulate the position of the foot in FIG. 3 but this can only be approximated because the foot can't bend along the metatarsal hinge line shown in FIG. 3. To make up the remaining flexion of the foot, the back of the foot rises slightly away from the rear sole section of the clog. This completes the motion and enables a free walking movement with clogs. In order to permit the back of the foot to rise away from the rear sole section of European style clogs, the back section of the upper on those clogs is open, exposing the heel of the foot. On Japanese geta, the entire upper is open, using only sandal thong straps.

The obvious disadvantage to such a design is that the upper must be open at least in the back, exposing the heel of the foot to possible cold and wet conditions. If the clog is given the ability to flex just a little along the natural metatarsal hinge line, the surface of the foot can stay in contact with the sole of the shoe throughout any walking motion and this would enable a clog-type shoe to be made with completely enclosed uppers such as those used on boots, for example. A close look at Kapskobund's patent shows that this is exactly what was intended with this design. In FIG. 1 of Kapskobund, the letter "v" points to an indentation or offset that goes all the way around the perimeter of the upper part of the clog. This recessed indentation is where the leather upper fits and is fastened to the wooden bottom of the shoe. In a normal clog, the offset area would not extend around the back of the clog as indicated by the rearmost "v" because that area would not have an upper attached there.

In order for a clog to perform its function of keeping a foot high and dry off the ground and yet also provide for free and easy movement, the clog must be capable of rocking down into the position shown in FIG. 5B. This requires an angled or curved lower surface to the front section of the clog. When walking, the forward-most-(and highest) point of the lower surface of the front section of the shoe rocks down to contact the ground, raising the heel and facilitating the walking movement. In order for the clog to be stable when standing on it so it won't unintentionally flip back and forth between the conditions shown in FIGS. 5A and 5B, certain geometrical constraints must apply.

These geometrical constraints can be seen in FIG. 6. The vertical rise 3 of the upper surface of the rear sole section which is the difference in height between the highest point 2 on that surface and the lowest point 1 on that surface must be less than the height 4 of the highest (forward-most) point of the lower surface of the front section of the shoe. Otherwise, a see-saw effect would occur between the positions seen in FIGS. 5A and 5B. The exact opposite relationship must exist in high heel shoes as designed conventionally or in the form of the invention. Stability in that case would have to be achieved by using a thin sole structure in combination with a reduction of the curvature of the bottom surface of the front section of the shoe. A shoe thus stabilized will no longer provide the functional raised-sole effect of clogs and thus these two types of shoes have a mutually converse property which makes them distinct and separate from each other.

It is possible to create platform high heel shoes but in reality they function just like stilts and nothing can be done with such a design to introduce stability or comfort. If high heels were attached to any clog(Kapskobund's design included), the clog would have no stability for standing or walking movements and would be dysfunctional, tending to remain in the position shown in FIG. 5B most of the time.

The patent searches also revealed numerous prior-art high heel shoe designs that claim to be capable of functioning with heels of different height. All of these designs have a conventional high heel arch shoe structure and except for the U.S. Patents to M. J. Dill (No. 4,670,996 dated Jun. 9, 1987) and F. T. Romano (No. 2,707,341 dated May 3, 1955), no mention is made of how to deal with the problems associated with a shoe sole structure making the transition between heel heights. Dill addresses this problem with the solution of a collapsible shank that retracts into a slot in the forward part of the shoe's sole. Apparently, this design presumes that the foot changes length when the heel height is changed. As was mentioned previously, however, and as is shown in FIGS. 2, 3, 7A, and 7B, there is a constant geometric relationship between the heel of the foot and the ball of the foot when weight is applied to the foot.

In all the prior art high heel shoe designs, the shank has a built-in curvature which can not be eliminated which is similar to the curvature found in conventional high heel shoes. Thus, those designs will not work for low heel shoes and will induce the same orthopedic discomfort found in conventional high heel shoes wherein unwanted stress will be imposed on the sensitive arch area of the foot, the ability for the ball and heel of the foot to bear weight naturally will be impeded and the heels will be twisted out of natural alignment resulting in lower back pain.

SUMMARY OF THE INVENTION

The present invention provides a high heel shoe designed such that the bottom of the foot of a wearer will contact the sole of the shoe along the same points that said foot would contact a smooth, level floor if standing with feet flat on said floor. Thus, the foot of a wearer is provided with the same support surface in a high heel shoe that would be present in a flat shoe. This is accomplished by hinging a rigid forward sole section and a rigid rear sole section with a planar upper surface to each other such that the straight hinge line passes below the lowest points of the first and fifth metatarsal heads of the foot of the wearer. The skeletal structure of the foot projects weight forward onto the metatarsal heads and any normally functioning foot will flex along a line which runs under the lowest points of the first and fifth metatarsal heads during walking or when standing in the high heel position.

The design of the sole of the invention eliminates most of the causes of discomfort present in conventional high heel shoes. No pressure is placed up into the sensitive arch area of the foot due to the planar nature of the upper surface of the rear sole section. The ball and heel of the foot are supported in the same manner as if standing on a flat surface and both can make firm contact with the sole of the shoe at the same time, unimpeded by the curvature present in the soles of typical high heel shoes. This fit between foot and shoe sole together with the hinging of the sole sections enables the shoe to correctly follow the movement of the foot, eliminating the chafing that occurs in conventional high heel shoes between the foot and the upper of the shoe. The rigid coupling between the forward and rear sole sections permits balancing forces from the toes to immediately counteract instability in the heel area thus eliminating the wobbling phenomenon present in typical high heel shoes. The upper surface of the rear sole section has the same medial to lateral tilt that is present during a normal walking motion and this has been found to eliminate the lower back pain associated with conventional high heel shoes.

Also, in keeping with the original design objective of the invention, the heels are removable and the sole structure will function properly for both high heel shoes and for low heel or flat shoes. This is possible because the shoe sole correctly tracks the movement of the foot during a normal walking motion and will provide a stable platform for heels as high as the maximum height the heel rises above the ground prior to the ball of the foot lifting from the ground. This is about a five inch heel height for the average size foot.

DESCRIPTION OF THE PREFERRED EMBODIMENTS

Figure 8:
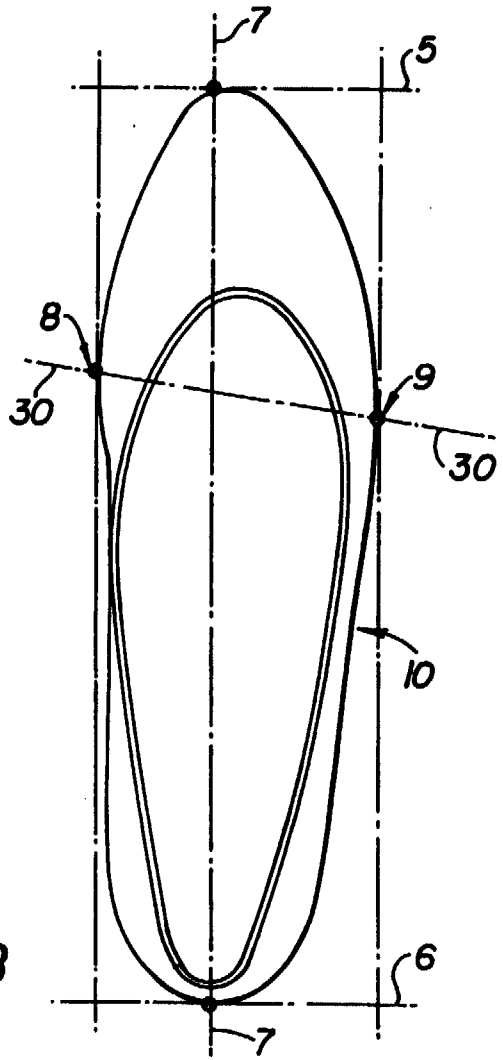
FIG. 8 is a plan view of a shoe constructed in accordance with the present invention.
Figure 9A:
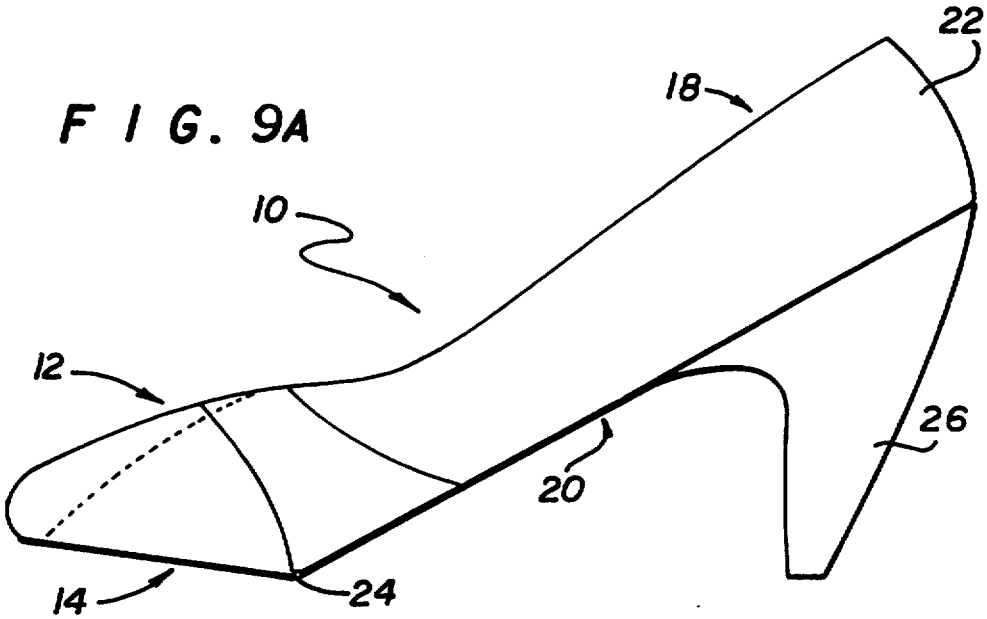
FIG. 9A is a side sectional view of a shoe constructed in accordance with the present invention.

Referring to FIGS. 8 and 9A, a shoe 10 constructed in accordance with the present invention provides a high heel shoe designed such that the bottom of the foot of a wearer will contact the sole of the shoe along the same points that said foot would contact a smooth, level floor if standing with feet flat on said floor. Thus, the foot of a wearer is provided with the same support surface in a high heel shoe that would be present in a flat shoe.

Figure 1:
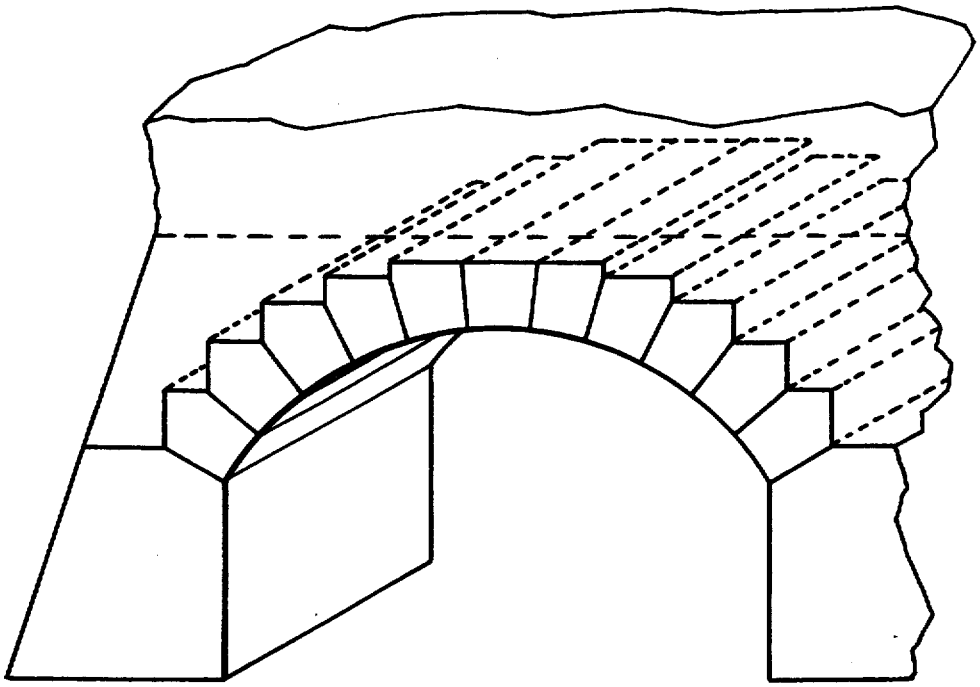
FIG. 1 shows an arch structure used in bridge construction.
Figure 2:
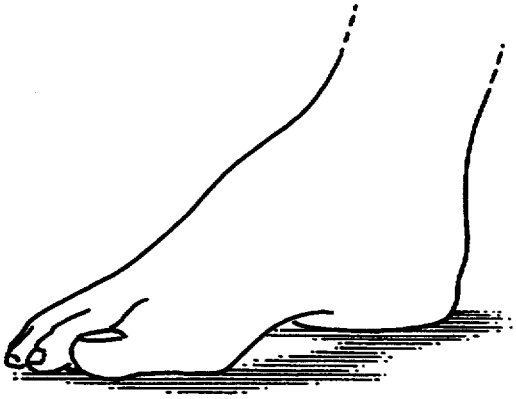
FIG. 2 shows a foot planted flat on the floor.

FIG. 1 shows an arch structure used in bridge construction. As can be seen, the arch is very strong when weight is applied against it in a downward direction but the arch may be damaged or broken if weight is applied against it in an upward direction. FIG. 2 shows a foot planted flat on a floor and it is seen that the arch area remains clear. The arch of a foot works the same way as the arch of a bridge in shifting weight applied above the arch to the lower terminating points of the arch. As with the bridge in FIG. 1, the foot in FIG. 2 should not have weight projected up into the bottom of the arch.

Figure 3:
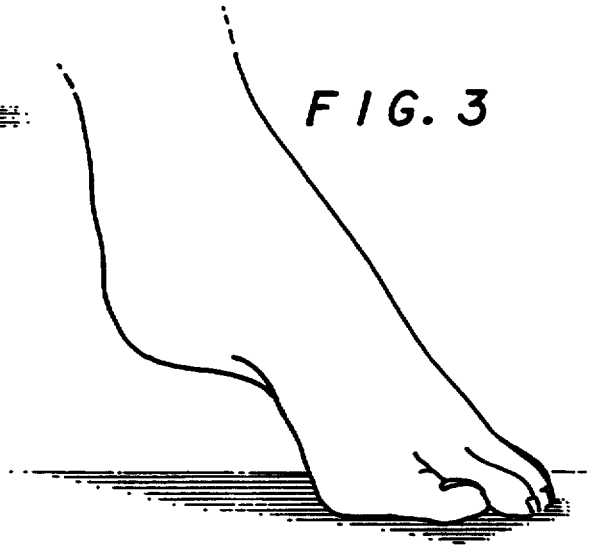
FIG. 3 shows a foot with the heel elevated to high heel height.

FIG. 3 shows that when the heel of a foot rises naturally, the ball of the foot stays planted firmly on the ground and the heel changes its vertical orientation to the ground such that the bottom of the foot on the medial side of the heel rises up higher off the ground than the bottom of the foot on the lateral side of the heel. FIG. 3 also shows that the shape of the arch does not change as the heel rises.

Figure 4A:
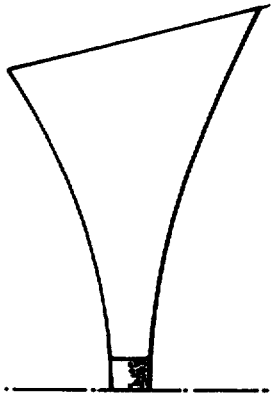
FIGS. 4A and 4B are rear sectional views of heels constructed in accordance with the present invention.
Figure 4B:
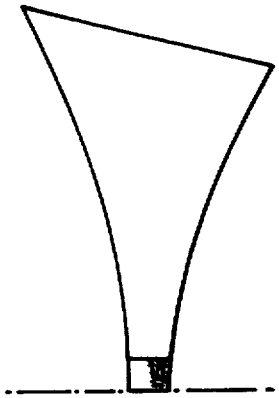

FIGS. 4A and 4B show this natural medial to lateral tilt built into the heels of the present invention as seen from the rear. It is believed that providing for this medial to lateral tilt eliminates the lower back pain found in conventional high heel shoes that take the foot in FIG. 3 and twist it so that the bottom of the foot in the heel area is parallel to the ground.

Figure 5A:
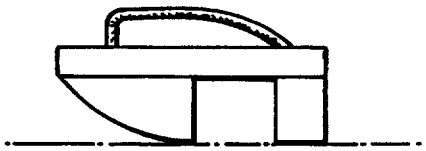
FIG. 5A PRIOR ART
FIGS. 5A, 5B, and 6 show prior art shoes with an elevated sole platform and the associated stability characteristics.
Figure 5B:
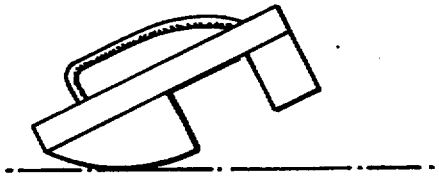
FIG. 5B PRIOR ART
Figure 6:
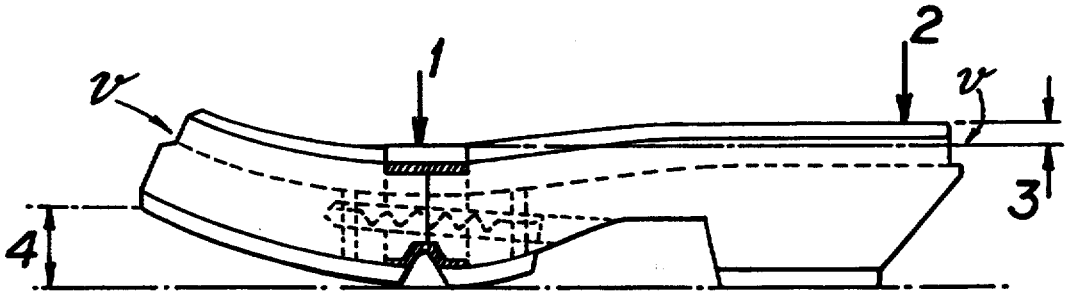
FIG. 6 PRIOR ART

FIGS. 5A and 5B show how elevated platform shoes such as clogs rotate to facilitate the walking motion. If a high heel is attached to such a shoe, it will tend to remain in the position of FIG. 5B, providing for an unstable shoe design. FIG. 6 shows the constraints that are needed for an elevated clog-type shoe to be stable. The vertical rise 3 of the upper surface of the rear sole section which is the difference in height between the highest point 2 on that surface and the lowest point 1 on that surface must be less than the height 4 of the highest (forward-most) point of the lower surface of the front section of the shoe. Otherwise, a see-saw effect would occur between the positions seen in FIGS. 5A and 5B. The exact opposite relationship must exist in high heel shoes as designed conventionally or in the form of the invention. Stability in that case would have to be achieved by using a thin sole structure in combination with a reduction of the curvature of the bottom surface of the front section of the shoe.

Figure 7B:
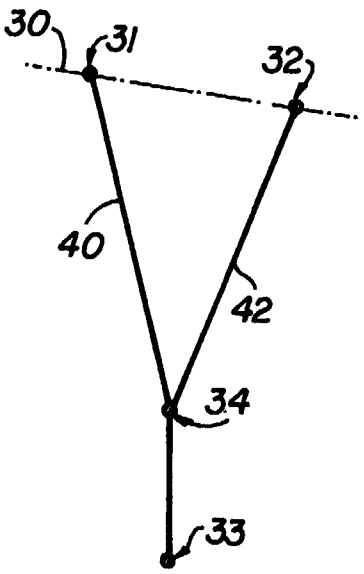
FIG. 7B shows the weight-bearing points of the bone structure of the foot shown in FIGS. 7A and 2.
Figure 7A:
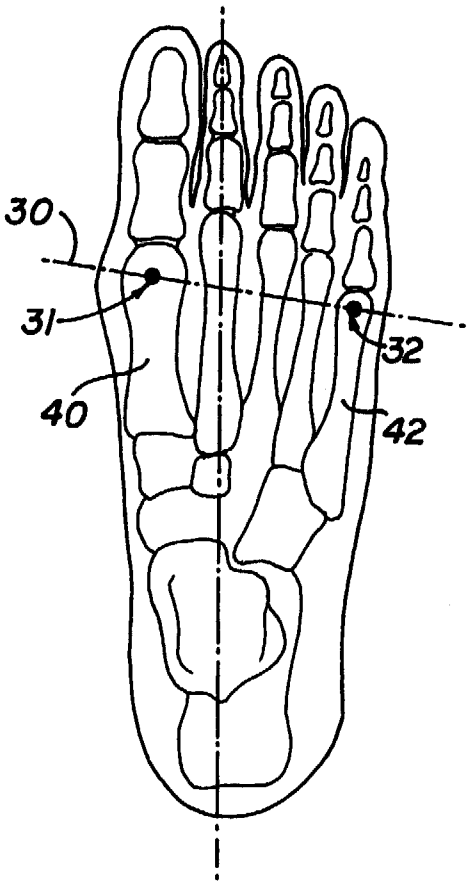
FIG. 7A is a representation of the anatomical structure of a foot in relation to the hinge line provided by the shoe illustrated in FIGS. 8, 9A, and 9B.

FIG. 7A shows the bone structure of the foot in FIG. 2. The simplified drawing in FIG. 7B can be used to analyze how the bone structure of the foot distributes weight when walking or standing. The weight from the leg comes down to the ankle 34 and is distributed rearward to the lowest point of the heel bone 33 and forward to the lowest point of the first metatarsal head 31 and forward to the lowest point of the fifth metatarsal head 32.

If a model of the bone structure of the foot were to be pressed flat against a level floor surface, it would be seen that the first metatarsal bone 40 does not touch the floor anywhere except point 31 which is the lowest point of the first metatarsal head. The fifth metatarsal bone 42 does not touch the floor anywhere except point 32 which is the lowest point of the fifth metatarsal head. The heel bone is seen to touch at point 33 which is the lowest point of that bone. A hinge line 30 connecting points 31 and 32 has been found to be the natural hinge line of the foot. Forward of hinge line 30, the second, third, and fourth metatarsal heads make contact with the floor and the bones from the toes also make contact. However, from the hinge line back to the rear of the foot, only points 31, 32, and 33 make contact and this weight-bearing tripod supports almost all of the weight from the leg when the foot is flat as in FIG. 2.

If the heel of the foot in FIG. 2 were to rise up off the floor as is the case for the foot in FIG. 3, point 33 would rise but points 31 and 32 would remain in firm contact with the floor. Furthermore, the planar relationship between points 31, 32, and 33 as seen in FIG. 7B would be preserved. The distances between points 33 and 31, 33 and 32, and 31 and 32 would be the same for a foot flat on the floor as in FIG. 2 or with the heel elevated as in FIG. 3. This is a law of nature based on the weight-bearing function of the skeleton of the foot and does not vary from individual to individual. The above analysis has been developed using models of the bone structure of the foot but experimentation shows that the relationship described is preserved in a fully functioning foot with all parts of the foot working together. Points 31, 32, and 33 would not be able to touch the floor directly in a complete foot, but they would still be the lowest weight-bearing points of the foot which would flex along hinge line 30 as described.

Figure 9B:
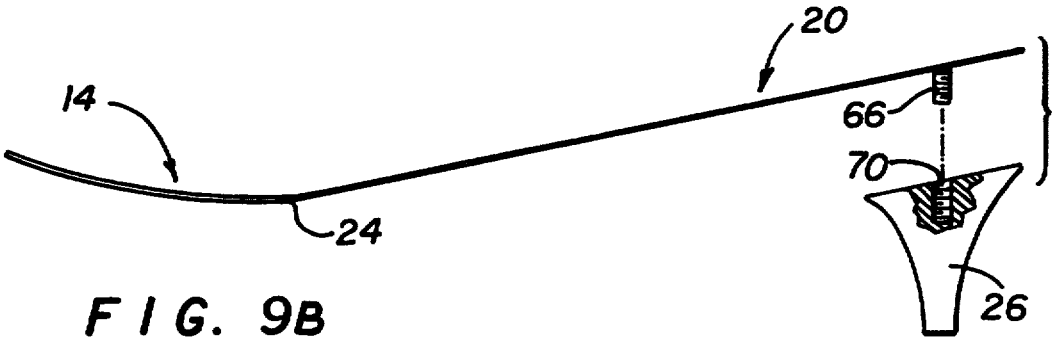
FIG. 9B is a side sectional view of a shoe sole structure constructed in accordance with the present invention.

Based on this principle, the present invention as shown in FIG. 9B has a front sole section 14 with an upper surface and a lower surface connected to a rear sole section 20 with a planar upper surface and a lower surface. The hinge coupling 24 holds the two sole sections together along a straight hinge line such that if the ground is flat and the shoe sole assembly is resting upright on the ground, the rear edge of the upper surface of the forward sole section and the forward edge of the upper surface of the rear sole section will be at the same height above the ground with no discontinuity in height across the upper surface of the hinged sole assembly.

FIG. 8 shows the placement of the hinge line in the sole structure of the shoe. If the shoe perimeter is placed flat on a surface between two parallel lines 5 & 6 such that each parallel line touches the perimeter at only one point and the distance between the parallel lines is at a maximum, then a line drawn through these two points defines the long axis 7 of the shoe. If a line is drawn parallel to the long axis touching the perimeter at only one point, that point being on the side closest to the other foot, that point will be defined as the most medial point on the sole perimeter 8. If another line is drawn parallel to the long axis touching the perimeter at only one point, that point being on the side furthest from the other foot, that point will be defined as the most lateral point on the sole perimeter 9. In a typical shoe of generally elliptical shape, the natural hinge line of the foot will coincide with a line passing through the points most lateral 9 and most medial 8 on the sole perimeter. The hinge line 30 in FIG. 8 will exactly match the hinge line 30 in FIGS. 7A and 7B. The foot of a wearer will adjust itself when settling into the shoe in FIG. 8 such that the lowest point of the first metatarsal head 31 and the lowest point of the fifth metatarsal head 32 will position themselves above hinge line 30 and will stay in that position while wearing the shoe whether walking or standing still.

The shoe sole of the present invention correctly tracks the movement of the foot during a normal walking motion and will provide a stable platform for heels as high as the maximum height the heel rises above the ground prior to the ball of the foot lifting from the ground. This is about a five inch heel height for the average size foot. A shoe constructed in accordance with the present invention is designed such that the forward sole section maintains a substantially fixed position with respect to the front of the wearer's foot and the rear sole section maintains a substantially fixed position with respect to the rear of the wearer's foot. All flexing of the shoe and foot are confined exclusively to the stated hinge line. Experimentation has shown that this design does not inhibit any walking or even dancing motions of the foot that the wearer may wish to make.

Thus, a shoe constructed in accordance with the present invention could be a high heel shoe wherein the high heels are removable and the shoe is capable of functioning as both a high heel and a low heel or flat heel shoe. As shown in FIG. 9B, heel 26 is shown in its detached state. Heel 26 has a threaded bore 70 and threaded fastening pin 66 is rigidly fixed to the underside of rear sole 20.

When an upper 22 is placed on the sole structure of FIG. 9B, the result can be seen in FIG. 9A. A front section 12 is produced which includes forward sole section 14 and the upper attached to it. A rear section 18 is produced which includes rear sole section 20 and the upper attached to it. The rear end of the upper attached to forward sole section 14 has an elastic extension that attaches to the forward part of rear sole section 20. The front end of the upper attached to rear sole section 20 has an elastic extension that attaches to the rear part of forward sole section 14. Thus, when the high heel 26 is removed, the shoe upper can adjust its shape and function as a flat heel shoe.

To construct such uppers, special lasts had to be made. A last is much like a wooden or hard plastic molding of the inside volume of the shoe. The last is placed against the sole of the shoe and the upper material is fitted and stiffened against the last to form the complete shoe. For flat heel shoes, the lasts very closely match the shape of a foot but for conventional high heel shoes, the lasts incorporate all the distortions present in the shape of conventional high heel shoes. Thus conventional high heel shoe lasts arch just the way the shoe does even though a foot does not arch this way. Also, conventional high heel shoe lasts have a deformed ball section designed to match the shape of conventional high heel shoes in this area. Additionally, conventional high heel shoe lasts do not take into account the correct medial to lateral tilt of the foot in the heel area.

Because the present invention provides a high heel shoe which supports the foot of a wearer as if the wearer were wearing flat heel shoes, flat shoe lasts were modified to provide the prototype lasts. The flat shoe lasts were cleanly cut along the hinge line described above and then ground along the ends facing the hinge so that they could be glued back together in such a manner that they correctly represented a foot in the natural high heel position as shown in FIG. 3 without the distortion present in conventional high heel lasts.

Figure 10A:
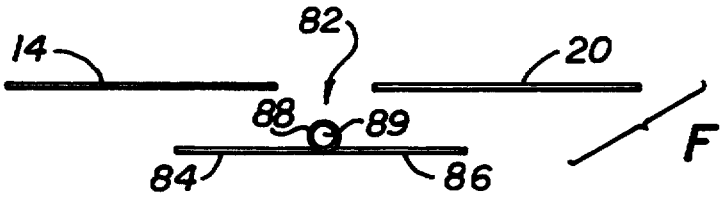
FIGS. 10A, 10B, and 10C are side views of alternative hinge constructions for the shoe illustrated in FIGS. 8, 9A, and 9B.
Figure 10B:
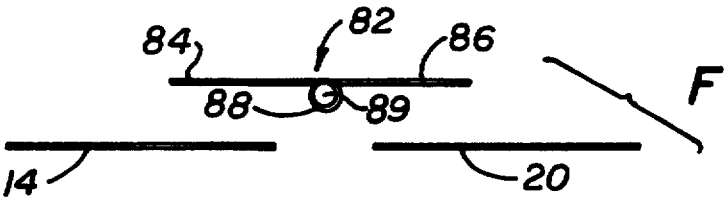
Figure 10C:
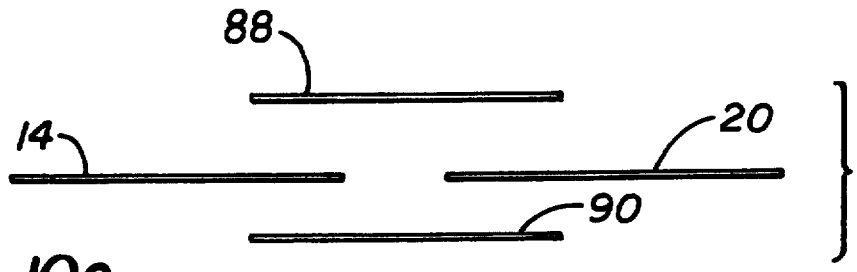

FIGS. 10A, 10B, and 10C illustrate various means of implementing the hinge 24 to connect the front sole section 14 and the rear sole section 20. In FIGS. 10A and 10B, a hinge 82 having a first mounting flange 84 and a second mounting flange 86 coupled together by hinge barrels 88 and a hinge pin 89 can be attached to front sole section 14 and rear sole section 20. The mounting flanges can be attached to the soles in a number of ways. The prototypes were made of aluminum and both flush riveting and welding were used to attach the hinges of different prototypes. The hinge barrels 88 can be oriented to either face upwardly as in FIG. 10A or can be oriented to face downwardly as in FIG. 10B. The prototypes using the design in FIG. 10B had the tops of surfaces 14 and 20 undercut to receive the hinge flush into the upper sole surface. Alternatively, as shown in FIG. 10C, a hinge connection can be formed by bonding two flexible strips 88 and 90 to the upper and lower surfaces of the front sole 14 and rear sole 20 such that each strip extends from one sole section to the other while the sole sections are held abutting each other. To reduce the weight of the sole structure, small holes can be drilled throughout sole sections 14 and 20 away from the hinge area.

Figure 11A:
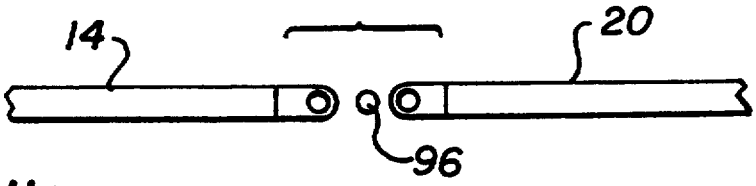
FIGS. 11A and 11B are side and plan views, respectively, of another alternate embodiment of the hinge construction for the shoe illustrated in FIGS. 8, 9A, and 9B.
Figure 11B:
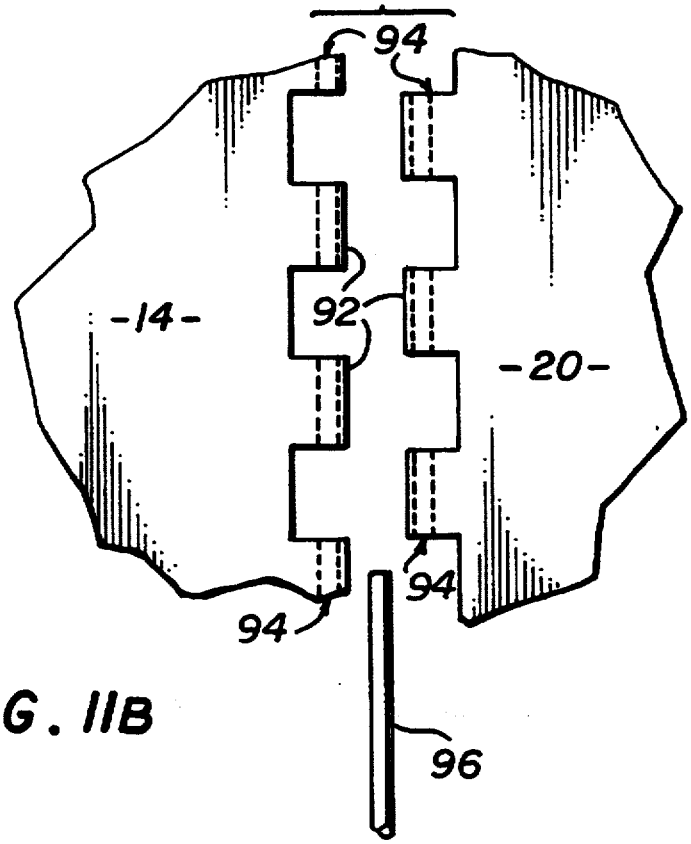

An alternate means of coupling the front sole section 14 and the rear sole section 20 can comprise hinge barrels integrally formed in the sole sections, as illustrated in FIGS. 11A and 11B. The sole sections 14 and 20 can be constructed such that the end of each sole section adjacent to the other sole section has a plurality of hinge barrels 92 with a hinge shaft 94 passing therethrough. When the sole sections are assembled, the hinge barrels 92 are interdigitated so that the shaft 94 passing through each hinge barrel is aligned with the shafts of the remaining hinge barrels. An elongated hinge pin 96 can then be inserted through the aligned shafts and secured in place.

In any of the hinges described above, the rigid sole sections and connecting hinge cooperate to provide a shoe sole with a great deal of torsional stiffness so that there is no lateral twisting of either the front sole section, the rear sole section, or the hinge interconnecting the front and rear sole sections. This feature allows balancing forces from the toes to be applied against the forward sole section to neutralize wobbling of the rear sole section resulting from the instability present when high heels are attached. Thus, the rear sole section 20 is free to pivot with respect to the forward sole section 14 by rotating axially about the hinge line 30 but cannot twist laterally with respect to the hinge line.

The design of the sole of the invention eliminates most of the causes of discomfort present in conventional high heel shoes. No pressure is placed up into the sensitive arch area of the foot due to the planar nature of the upper surface of the rear sole section. The ball and heel of the foot are supported in the same manner as if standing on a flat surface and both can make firm contact with the sole of the shoe at the same time, unimpeded by the curvature present in the soles of typical high heel shoes. This fit between foot and shoe sole together with the hinging of the sole sections enables the shoe to correctly follow the movement of the foot, eliminating the chafing that occurs in conventional high heel shoes between the foot and the upper of the shoe. The rigid coupling between the forward and rear sole sections permits balancing forces from the toes to immediately counteract instability in the heel area thus eliminating the wobbling phenomenon present in typical high heel shoes. The upper surface of the rear sole section has the same medial to lateral tilt that is present during a normal walking motion and this has been found to eliminate the lower back pain associated with conventional high heel shoes.

In order to convey an understanding of the present invention, it has been described above in terms of presently preferred embodiments. However, there are many configurations for hinged high heel shoes with detachable heels that are not specifically described herein but with which the present invention is applicable. Therefore, the present invention should not be seen as limited to the particular embodiments described herein because it has applicability to a wide variety of shoe designs. All modifications, variations or equivalent arrangements that are within the scope of the attached claims should be considered to be within the scope of the invention.

With the above paragraph in mind, several modifications have been anticipated that will weaken the quality of the present invention but which will still preserve most of the improvements that make the present invention better that conventional high heel shoes and enable the invention to work with heels of different height. The upper surface of the rear sole section does not have to be perfectly planar although a planar design is best because no two people have the exact same contour to the bottom of their feet and a planar surface will always correctly support any foot. The bottom of most feet rise in the arch area under the first metatarsal bone so the sole could rise in this area to some extent and still work properly. The sole could be indented under the heel and/or under the metatarsal head area and still function as described above. Thus, the general contour of the bottom of a foot could be impressed into the upper surface of the rear sole section and the invention would still work. This would not bring the shoe closer to a conventional high heel shoe structure but would be like imposing a molded foot-bed sole structure onto the disclosed design. It is not believed that there would be any benefit to such a modification but it is being mentioned as being within the scope of the invention for disclosure purposes.

The best design has the top of the hinge line being parallel to the ground if the ground is flat and the shoe is resting upright on the ground. Minor deviations from this parallel condition would degrade the performance of the shoe but it would still work.

It has been found that the best possible design for the present invention is to have two rigid sole pieces hinged as described. The invention will still function if the forward sole section is flexible although stability and comfort will be compromised. Similarly, the invention will still work if there are multiple forward sole parts hinged together forward of the hinge line described in this disclosure although this will degrade the comfort and stability present in the disclosed design.

I claim:

1. A shoe having a hinged sole assembly comprising:

a forward sole section having an upper surface and a lower surface; and a rigid rear sole section having a substantially planar upper surface and a lower surface; and a hinge connecting said rear sole section to said front sole section in pivotable connection along a straight hinge line, and wherein a reference line passing through the two points of the hinged sole assembly perimeter that are furthest apart defines a longitudinal axis, and wherein a medial reference line on the medial side of the sole perimeter parallel to the longitudinal axis which passes through the perimeter of the sole at the point furthest from the longitudinal axis defines one point on the sole perimeter through which the hinge line of said hinge passes, and wherein a lateral reference line on the lateral side of the sole perimeter parallel to the longitudinal axis which passes through the perimeter of the sole at the point furthest from the longitudinal axis defines the other point on the sole perimeter through which the hinge line of said hinge passes, and wherein said rear sole section has a high heel attached to the rear of the bottom surface of said rear sole section such that when the shoe sole assembly is resting upright on level ground, the difference in height above said ground of the highest point on the upper surface of said rear sole section and the lowest point on the upper surface of said rear sole section is at least one inch and not more than five inches.

2. A shoe as in claim 1 further comprising means for removing the heel.

3. A shoe as in claim 1 wherein the upper surface of the rear sole section has a small concave depression in the heel area.

4. A shoe as in claim 1 wherein the upper surface of the rear sole section has a small convex rise centered on the medial side of the sole perimeter midway between the hinge and the heel area.

* * * * *